US006248212B1

(12) United States Patent
Anderson et al.

(10) Patent No.: US 6,248,212 B1
(45) Date of Patent: Jun. 19, 2001

(54) THROUGH-AIR-DRIED POST BONDED CREPED FIBROUS WEB

(75) Inventors: Ralph L. Anderson, Marietta; Tom C. Saffel, Alpharetta, both of GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/000,584

(22) Filed: Dec. 30, 1997

(51) Int. Cl.[7] ..... D21H 19/72; D21H 19/74

(52) U.S. Cl. ..... 162/112; 162/113; 162/147; 162/134; 162/137

(58) Field of Search ..... 162/109, 111, 162/112, 147, 113, 134, 137

(56) References Cited

U.S. PATENT DOCUMENTS

| | | | | |
|---|---|---|---|---|
| 3,414,459 | | 12/1968 | Wells . | |
| 3,432,936 | | 3/1969 | Cole et al. . | |
| 3,556,907 | | 1/1971 | Nystrand . | |
| 3,879,257 | * | 4/1975 | Gentile et al. | 162/112 |
| 4,125,659 | * | 11/1978 | Klowak et al. | 162/112 |
| 4,158,594 | * | 6/1979 | Becker et al. | 162/112 |
| 4,166,001 | * | 8/1979 | Dunning et al. | 162/112 |
| 4,351,699 | * | 9/1982 | Osborn, III | 162/112 |
| 4,507,173 | * | 3/1985 | Klowak et al. | 162/112 |
| 4,556,450 | | 12/1985 | Chuang et al. . | |
| 4,894,118 | * | 1/1990 | Edwards et al. | 162/147 |
| 5,048,589 | | 9/1991 | Cook et al. . | |
| 5,228,954 | * | 7/1993 | Vinson et al. | 162/147 |
| 5,292,438 | | 3/1994 | Lee . | |
| 5,348,620 | * | 9/1994 | Hermans et al. | 162/147 |
| 5,501,768 | * | 3/1996 | Hermans et al. | 162/147 |
| 5,674,590 | * | 10/1997 | Anderson et al. | 428/154 |
| 5,679,218 | * | 10/1997 | Vinson et al. | 162/147 |

FOREIGN PATENT DOCUMENTS

| | | |
|---|---|---|
| 0 115 172 | 8/1984 | (EP) . |
| 0604 824 A1 | 6/1994 | (EP) . |

OTHER PUBLICATIONS

Rydholm, Pulping Processes, (1967), Interscience Publishers, pp. 362, 611, 612, 652, and 653.*

* cited by examiner

*Primary Examiner*—Peter Chin
(74) *Attorney, Agent, or Firm*—Brinks Hofer Gilson & Lione

(57) ABSTRACT

A web structure is formed by a process including first through-air drying the fibrous web comprising at least about 20% non-premium fiber, next applying a bonding material to the fibrous web, and next creping the fibrous web to form the web structure having a BLK/BW and CCDWT at least 85% of a wet-pressed web structure comprising 100% premium fiber. The web structure may alternatively or in addition to have a TWA and/or BLK/BW greater than the TWA and/or BLK/BW of a through-air-dried, bonded, and creped web structure comprising 100% premium fiber. The process may be repeated on the second side. The web structure may comprise a combination of hardwood, softwood, CTMP, and/or recycled fibers. The web structure may include at least about 40% recycled fibers.

92 Claims, 6 Drawing Sheets

FIG. 8

| PRODUCT DESCRIPTION | MD | MDS | CD | CDS | CCDWT | BULK | BW | BLK/BW | TABOR ABR | TWA | OILCAP | Z PEEL |
|---|---|---|---|---|---|---|---|---|---|---|---|---|
| | OZ | % | OZ | % | OZ | MILS/ 24 PLY | #2880 SQ. FT. | MILS/# | CYCLES | G/M2 | % | LBS |
| A) | | | | | | | | | | | | |
| 1) 40% CURLED RF 65gsm-UCTAD | 52.8 | 30.4 | 38.1 | 16.7 | 25.4 | 681 | 49.6 | 13.7 | 12.0 | 593 | 540 | 02.3 |
| 2) 40% RF, 65gsm-UCTAD | 58.5 | 30.0 | 39.0 | 13.6 | 24.9 | 652 | 49.3 | 13.2 | 11.7 | 546 | 492 | 03.0 |
| 3) OLDS PINE/CTMP 40% MIDDLE-UCTAD | 57.1 | 28.6 | 37.4 | 13.7 | 24.9 | 736 | 49.6 | 14.8 | 19.0 | 621 | 522 | 01.7 |
| 4) 40% CURLED RF HOMOGENEOUS MIX 65gsm-UCTAD | 51.3 | 20.5 | 35.0 | 12.5 | 23.3 | 736 | 49.0 | 15.0 | 2.3 | 632 | 547 | 01.2 |
| 5) 40% CURLED RF HOMOGENEOUS MIX 65gsm-UCTAD | 51.5 | 25.6 | 35.5 | 30.0 | 24.3 | 738 | 49.4 | 14.9 | 8.3 | 632 | 556 | 01.3 |
| B) | | | | | | | | | | | | |
| 1) 100% NSWK 65gsm-UCTAD | 58.3 | 35.3 | 42.3 | 16.4 | 26.2 | 596 | 50.8 | 11.7 | 13.7 | 511 | 432 | 00.7 |
| C) | | | | | | | | | | | | |
| 1) STRATIFIED CURLED 40% RF-65gsm-W PRESS | 45.0 | 60.3 | 41.8 | 20.4 | 23.6 | 599 | 50.9 | 11.8 | 11.3 | 485 | 445 | 02.5 |
| 2) 100% NSWK 65gsm-W PRESS | 43.1 | 56.6 | 39.1 | 21.8 | 25.9 | 724 | 51.5 | 14.1 | 11.3 | 537 | 551 | 01.4 |

FIG. 9

| SAMPLE | MDS | CDS | MDS | CCDWT | B.W. | BLK/BW | PRINT PRESSURE |
|---|---|---|---|---|---|---|---|
| 1) NSWR WET PRESS | 13.5 | 9.1 | 25 | 3.9 | 29.5 | 14.7 | 10/10 |
| 2) THROUGH-DRIED-40% BLEACHED OCC | 14.1 | 13.1 | 26 | 4.5 | 31.7 | 14.5 | 30/40 |
| 3) THROUGH-DRIED NSWK NO DEBONDER | 16.2 | 13.1 | 25.4 | 7.0 | 30.9 | 17.1 | 20/20 |
| 4) THROUGH-DRIED NSWK 0.2% DEB. | 23.0 | 11.6 | 27 | 6.2 | 30.0 | 19.1 | 20/20 |
| 5) THROUGH-DRIED NSWK 15% 14" POLYESTER IN MIDDLE | 27 | 14.8 | 28.6 | 6.1 | 31 | 17.4 | 10/10 |

THROUGH-AIR-DRIED POST BONDED CREPED FIBROUS WEB

FIELD OF THE INVENTION

The current invention is generally related to fibrous webs and a method of producing such webs that are characterized by high tensile strength, high water absorbency and low density without sacrificing softness, and more particularly related to fibrous webs that contain certain fibers oriented in a predetermined vertical direction. More particularly, the invention relates to fibrous webs which are through-air-dried, bonded, and creped, and webs made by this process and including a high percentage of non-premium or recycled fibers.

BACKGROUND OF THE INVENTION

Disposable paper products have been used as a substitute for conventional cloth wipers and towels. In order for these paper products to gain consumer acceptance, they must closely simulate cloth in both perception and performance. In this regard, consumers should be able to feel that the paper products are at least as soft, strong, stretchable, absorbent, and bulky as the cloth products. Softness is highly desirable for any wipers and towels because the consumers find soft paper products more pleasant. Softness also allows the paper product to more readily conform to a surface of an object to be wiped or cleaned. Another related property for gaining consumer acceptance is bulkiness of the paper products. However, strength for utility is also required in the paper products. Among other things, strength may be measured by stretchability of the paper products. Lastly, for certain jobs, absorbency of the paper products is also important. As prior art shows, some of the above-listed properties of the paper products are somewhat mutually exclusive. In other words, for example, if softness of the paper products is increased, as a trade-off, its strength is usually decreased. This is because conventional paper products were strengthened by increasing interfiber bonds formed by the hydrogen bonding and the increased interfiber bonds are associated with stiffness of the paper products. Another example of the trade-off is that an increased density for strengthening the conventional paper products also generally decreases the capacity to hold liquid due to decreased interstitial space in the fibrous web.

To control the above trade-offs, some attempts had been made in the past. One of the prior art attempts to increase softness in the paper products without sacrificing strength is creping the paper from a drying surface with a doctor blade. Creping disrupts and breaks the above-discussed interfiber bonds as the paper web is fluffed up. As a result of some broken interfiber bonds, the creped paper web is generally softened. Other prior art attempts at reducing stiffness in the paper products include chemical treatments. Instead of the above-discussed reduction of the existing interfiber bonds, a chemical treatment prevents the formation of the interfiber bonds. For example, some chemical agent is used to prevent the bond formation. In the alternative, synthetic fibers are used to reduce affinity for bond formation. Unfortunately, all of these past attempts failed to substantially improve the trade-offs and resulted in the accompanying loss of strength in the web.

Further attempts were made to reinforce the weakened paper structure that had lost strength after the above-discussed treatments. The web structure can be strengthened by applying bonding materials to the web surface. However, since the bonding material generally reduces the interstitial space, the bonding application also reduces absorbency in the web structure. In order to maintain the absorbency characteristic, as disclosed in U.S. Pat. Nos. 4,158,594 and 3,879,257 (hereinafter the '257 patent), the bonding material may be advantageously applied in a spaced-apart pattern, and the applied area is followed by fine creping for promoting softness. Although these improvements are useful for light paper products such as tissue and towel, it is less suitable for heavier paper products which require higher abrasion resistance and strength.

One of the commonly used techniques to solve the above problem is to laminate two or more conventional webs with adhesive as disclosed in U.S. Pat. Nos. 3,414,459 and 3,556,907. Although the laminated multi-ply paper products have the desirable bulk, absorbency and abrasion-resistance for heavy wipe-dry applications, the multi-ply products require complex manufacturing processes.

In the alternative, to increase abrasion resistance and strength without sacrificing other desirable properties and complicating the manufacturing process, the '257 patent discloses the bonding material applied to a web in a spaced-apart pattern. The web structure used in the '257 patent includes only short fibers and a combination of short fibers and long fibers and forms a single laminar-like structure with internal cavities. Some short fibers are randomly oriented in the cavities to bridge outer layers so as to enhance abrasion resistance. At the same time, the remaining space in the cavity provides high absorbence. Although the '257 patent anticipated heavy uses, industrial applications require durable and highly absorbent paper products. The '257 patent used long fibers for enhancing only the strength of the web structure. However, such heavy duty paper products necessitate the web structure with a higher total water absorption ("TWA") and a higher abrasion resistance while retaining bulk and other desirable properties.

The U.S. Government has recently mandated that wipers sold to any U.S. Government Agencies must contain 40% of post consumer fiber (recycled fiber). In addition, the EPA may eventually require 40% or more recycled fiber in all wipers sold. One problem with using high percentages (40% or greater) of recycled fiber is that the strength, softness and bulk may be decreased by 20% through 30%. Even when the web containing the recycled fiber is double recreped, the strength, softness and bulk may be less than adequate. Similar inadequate properties arise when using other non-premium fibers including CTMP (chemi-thermomechanical pulp), and unbleached recycled fiber, which have a lower propensity for accepting chemical debonder.

In summary, as discussed above, there remains a number of problems for towel products. The prior attempts have either trade-offs among the desirable properties or require a complex process. It would accordingly be desirable to have an improved process to increase the strength, bulk and softness of the product and allow the production of a product with high percentages of non-premium fibers, including recycled fibers.

SUMMARY OF THE INVENTION

One aspect of the invention provides a web structure comprising a through-air-dried, bonded, and creped fibrous web comprising at least about 20% non-premium fiber, bonding material applied portions across the web, and the web structure having a BLK/BW (Bulk to Basis Weight) and a CCDWT (Cured Cross-Directional Wet Tensile) of at least 85% of the BLK/BW and CCDWT of a wet-pressed web structure comprising 100% premium fiber. The web structure may alternatively or in addition have a TWA (Total Water Absorbency) and/or BLK/BW than the TWA and BLK/BW of a through-air-dried, bonded, and creped web structure comprising 100% premium fiber. The bonding material may be applied to one side of the fibrous web and creped on the same side. The bonding material may also be applied to a second side of the fibrous web and then creped on the second side. The fibrous web may comprise between about 20% and 100% of recycled fibers. Other combinations of softwood fibers, CTMP (chemi-thermomechanical pulp) fibers, polyester fibers, and hardwood fibers may also be used. The fibrous web may include chemical debonder, but it is not necessary. Preferably, the fibrous web is subjected to a negative draw of between about 3% and 20%, and more preferably between 10% and 15%.

Another aspect of the invention provides a method forming a fibrous web. A fibrous web comprising at least about 20% non-premium fiber is provided. The fibrous web is then through-air-dried. Bonding material is then applied to the fibrous web. The web with the bonding material is then dried. Then the fibrous web is creped to form a web structure having a Bulk and a CCDWT of at least about 85% of the Bulk and CCDWT of a wet-press web structure comprising a 100% premium fiber. The bonding material may be applied to a first side of the web and then dried and then creped on the first side. Next the bonding material may be applied to a second side of the web and then dried and creped on the second side. Preferably, a negative draw is provided between about 10% and 15%. The web structure may alternatively or in addition have a TWA and a BLK/BW greater than the TWA and BLK/BW of a through-air-dried, bonded, and creped web structure comprising a 100% premium fiber.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

FIG. 8 is a chart illustrating various examples of product prepared by both wet-pressing and the through-air-dried double recrepe process; and FIG. 9 is a chart illustrating various examples of product prepared by both wet-pressing and the through-air-dried double recrepe process.

DETAILED DESCRIPTION OF THE PRESENTLY PREFERRED EMBODIMENTS

U.S. Pat. No. 5,048,589 (hereinafter the '589 patent) issued to Cook et al. and U.S. Pat. No. 3,879,257 (hereinafter the '257 patent) issued to Gentile et al. are hereby incorporated by reference into this application.

The fibrous web structure in accordance with the current invention is preferably made by a process in which the fibrous web comprising at least about 20% non-premium fiber (which includes recycled, CTMP and/or unbleached recycled fiber) is first through-air-dried. A bonding material is next applied to the web and dried. The fibrous web is next creped to form the web structure that has bulk and line cross-directional web tensile (CCDWT) of at least about 85% of the bulk or BLK/BW and CCDWT of a wet-pressed web structure comprising 100% premium fiber, for example, 100% Northern Soft Wood Kraft (NSWK). The web structure made by the above process also has a Total Water Absorbency (TWA) which is greater than the TWA of a web structure comprising 100% premium fiber, made by the same process or by a wet-pressing process. In a preferred embodiment, the fibrous web may include at least about 40% of recycled fibers. The application of bonding material and creping may be done to one side and then, if desired, repeated on a second side. All the fibers in the web may be of similar or varying lengths. The fibrous web may preferably include both short fibers and long fibers in a predetermined range of ratios. Alternatively, in another preferred embodiment, the fibrous web structure may include all short fibers made with between 10% through 100% of recycled fiber. In a preferred embodiment, the short fibers range from approximately 70% to approximately 95% of the total weight of the web structure, while the long fibers range from approximately 5% to approximately 30% of the total weight of the web structure. The short fibers may be 100% recycled fiber, or a combination of recycled fibers and, for example, Northern Soft Wood Kraft (NSWK) and/or softwood chemi-thermomechanical pulp (CTMP). Both NSWK and CTMP are less than 3 mm in length (as determined by KAJANNI test method). CTMP has a wet stiff property for stabilizing the web structure when the web structure holds liquid. The long fibers, on the other hand, generally may be natural redwood (RW), cedar, and/or other natural fibers, or synthetic fibers. Some examples of the synthetic fibers include polyester (PE), rayon and acrylic fibers, and they come in a variety of predetermined widths. Each of these long fibers is generally from approximately 5 mm to approximately 9 mm in length.

Figures 1, 2:
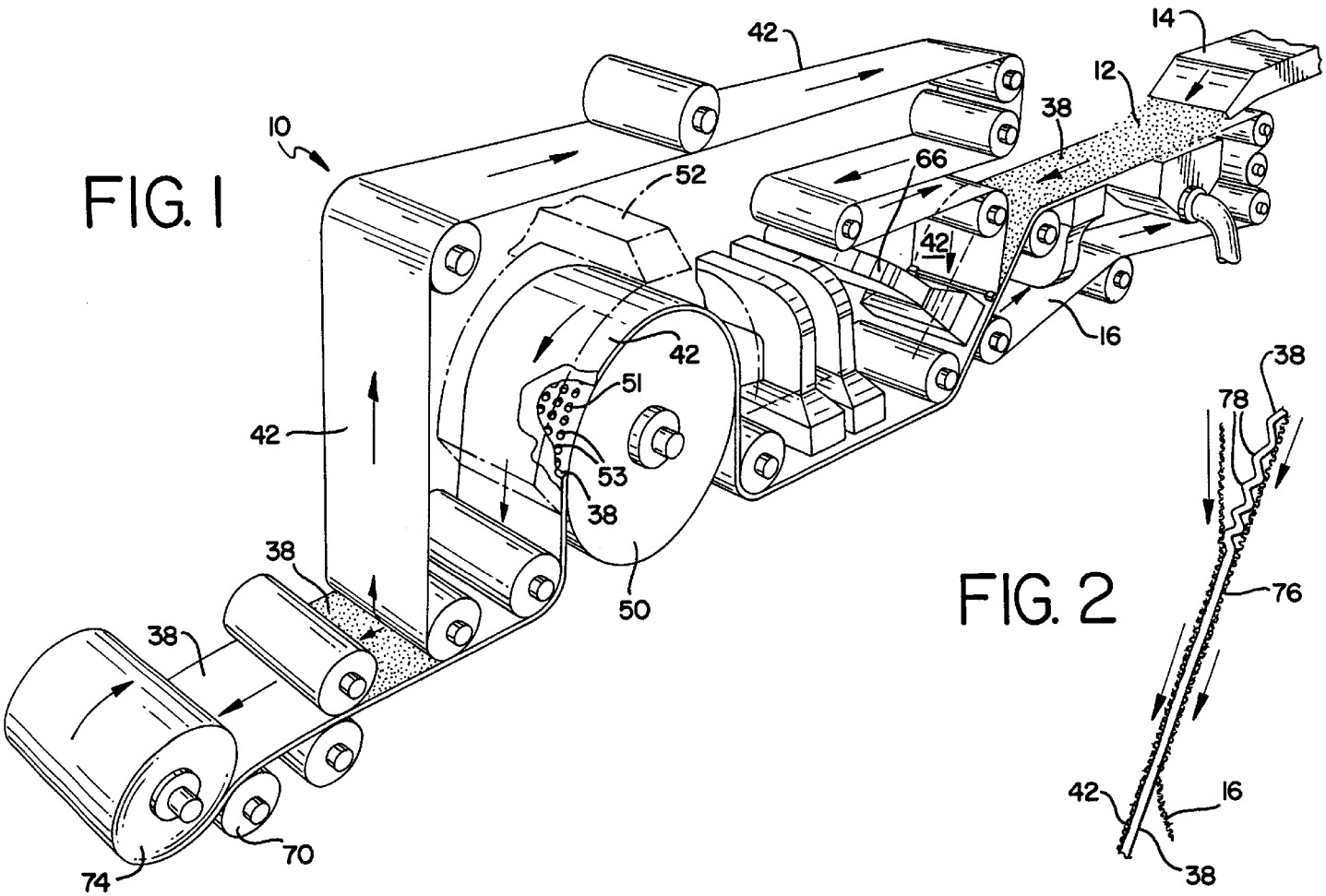
FIG. 1 is a perspective view of a preferred embodiment of a process line for producing a through-air-dried web.
FIG. 2 is an enlarged sectional view of the point of transfer between the forming belt and the through-dryer belt in a process line for producing a negative draw.

In FIG. 1 a preferred embodiment of the through-air-dried processes is shown. However, other preparation techniques or papermaking machines may be used to form the web structure from the above-described compositions. Referring to FIG. 1, there is illustrated a process line 10 for producing a first preferred embodiment of the present invention. The process line 10 begins with a papermaking furnish 12 comprising a mixture of secondary cellulosic fiber, water, and may include a chemical debonder. The furnish 12 is deposited from a conventional head box (not shown) through a nozzle 14 on top of a forming belt 16 as shown in FIG. 1. The forming belt 16 travels around a path defined by a series of guide rollers.

After passing over the vacuum box, the partially dewatered fibrous web 38 is carried by the forming belt 16 in the counterclockwise direction, as shown in FIG. 1, towards the through-air dryer 50.

A vacuum pickup 66 pulls the fibrous web 38 towards the through-dryer belt 42 and away from forming belt 16 as the fibrous web 38 passes between the through-dryer belt 42 and the forming belt 16. The fibrous web 38 adheres to the through-dryer belt 42 and is carried by the through-dryer belt 42 towards the through-dryer 50.

The through-dryer 50 generally comprises an outer rotatable perforated cylinder 51 and an outer hood 52 for receiving the hot air blown through the perforations 53, the fibrous web 38, and the through-dryer belt 42 as is known to those skilled in the art. The through-dryer belt 42 carries the fibrous web 38 over the upper portion of the through-dryer outer cylinder 50. The heated air forced through the perforations 53 in the outer cylinder 51 of the through-dryer 50, removes the remaining water from the fibrous web 38. The temperature of the air forced through the fibrous web 38 by the through-dryer 50 may preferably be, for example, about 300° F. to 400° F.

The dried fibrous web 138 may pass from the through-dryer belt 42 to a nip between a pair of embossing rollers. The dried fibrous web 38 then passes to the takeup roller 70 where the fibrous web 38 is wound into a product roll 74.

In an even more preferred embodiment of the present invention, the process line 10 previously described is modified so that the through-dryer belt 42 travels at a velocity slower than the velocity of the forming belt 16. This process is known in the art as "negative draw." Preferably, the through-dryer belt 42 travels at a velocity from about 3% to about 20%, and preferably 10% to about 15% slower than the velocity of the forming belt 16. As a result, the moist fibrous web 38 arrives at the point of transfer 76 between the forming belt 16 and the through-dryer belt 42 at a faster rate than the fibrous web 38 carried away by the through-dryer belt 42. As the moist fibrous web 38 builds up at the point of transfer 76, the moist fabric tends to bend into a series of transverse folds 78, as shown in FIG. 2. The folds 78 provide for a degree of stretch in the fibrous web 38 thereby increasing the overall strength of the fibrous web 38, and because the folds 78 stack on top of one another, the fibrous web 38 becomes thicker and thus softer. As described in U.S. Pat. No. 5,048,589, an alternative preferred embodiment wherein two belts replace the single through-air-dryer belt 42 may be used.

One preferred embodiment of the web 119 according to the current invention includes recycled, NSWK, CTMP and PE fibers and has a basis weight which ranges from approximately 22 lbs/ream to 55 lbs/ream depending upon the compositions and a preparation process. These fibers may be stratified into layers or mixed in a homogeneous single layer. When the web 119 is stratified in a preferred embodiment, the recycled and PE fibers are disposed in outer layers while the NSWK and CTMP fibers are disposed in a middle layer. This stratification will enhance the softness and bulk of the outer layers. In the homogeneous web structure, all of these fibers are homogeneously present across the width of the structure. In either layer structure, since the recycled, CTMP and the synthetic fibers have low bonding properties, they do not tend to create tight bonding in the web structure 119. Thus, these fibers serve as a partial debonder, and, as a result, the web 119 containing these fibers has a high degree of softness. In addition, the recycled and CTMP fibers do not become flexible when they are wetted. This wet stiff characteristic of the recycled and CTMP fibers also serves as a reinforcer to sustain a high total water absorbance (TWA) in the web structure. For the above reasons, the web containing the long fibers and the recycled and CTMP short fibers has a high TWA value without sacrificing softness. As will be described later, the orientation of these fibers further substantially enhances these desirable properties of the web structure.

Figure 3:
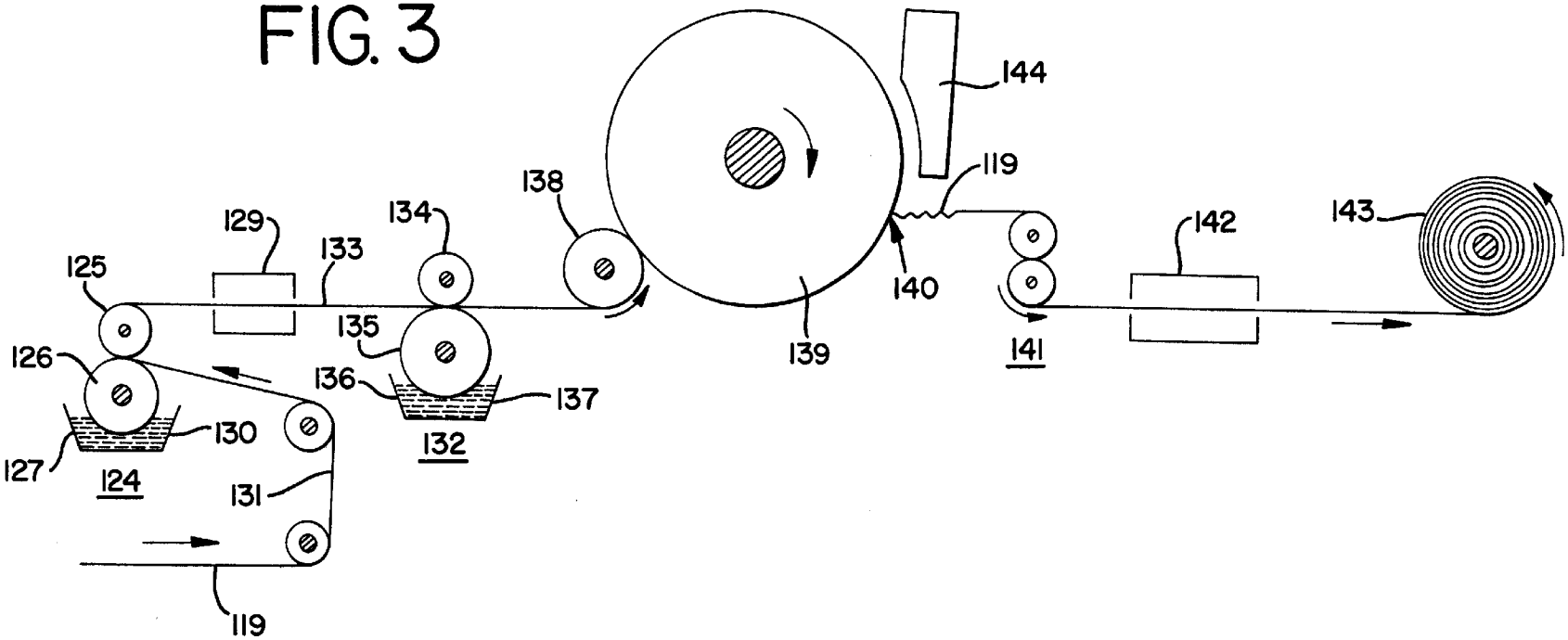
FIG. 3 illustrates one embodiment of creping apparatus according to the current invention.

The above-prepared web is then treated in accordance with a method of the current invention for further enhancing the desired properties for heavy wiper towel paper products. Referring now to the drawings, wherein like reference numerals designate the corresponding structure throughout the views, and referring in particular to FIG. 3, which illustrates one form of apparatus to practice the current invention. The embodiment of the papermaking machine as shown in FIG. 3, is generally identical to those disclosed in the '257 patent except for a high temperature, positive airflow hood 144 placed near a doctor blade 140. The hood 144 is operated at a substantially higher temperature than the dryer drum, so as to create a temperature differential between the top and bottom of the sheet. However, this papermaking machine is only illustrative and other variations exist within the spirit of the current invention.

Still referring to FIG. 3, the above-described web 119 is fed into a first bonding material application station 124 of the papermaking machine. The first bonding material application station 124 includes a pair of opposing rollers 125, 126. The web 119 is threaded between the smooth rubber press roll 125 and the patterned metal rotogravure roll 126, whose lower transverse portion is disposed in a first bonding material 130 in a holding pan 127. The first bonding material 130, is applied to a first surface 131 of the web 119, in a predetermined geometric pattern as the metal rotogravure roll 126 rotates. The above-applied first bonding material 130 is preferably limited to a small area of the total first surface area so that a substantial portion of the first surface area remains free from the bonding material 130. Preferably, the patterned metal rotogravure 126 should be constructed such that only about 15% to 60% of the total first surface area of the web 119 receives the bonding material 130, and approximately 40% to 85% of the total first surface area remains free from the first bonding material 130.

Figure 5:
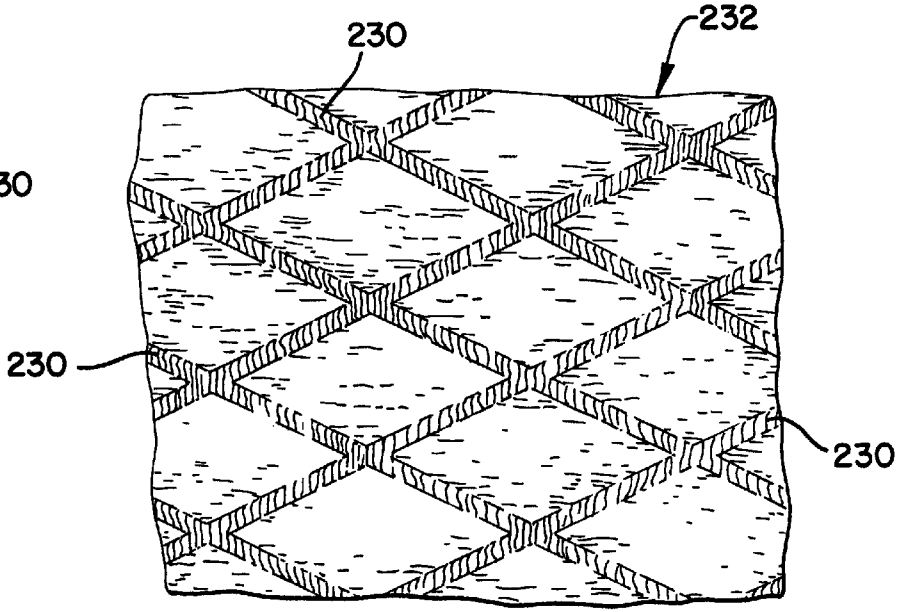
FIG. 5 illustrates a connected mesh pattern of the bonding material applied on the web structure.
Figure 4:
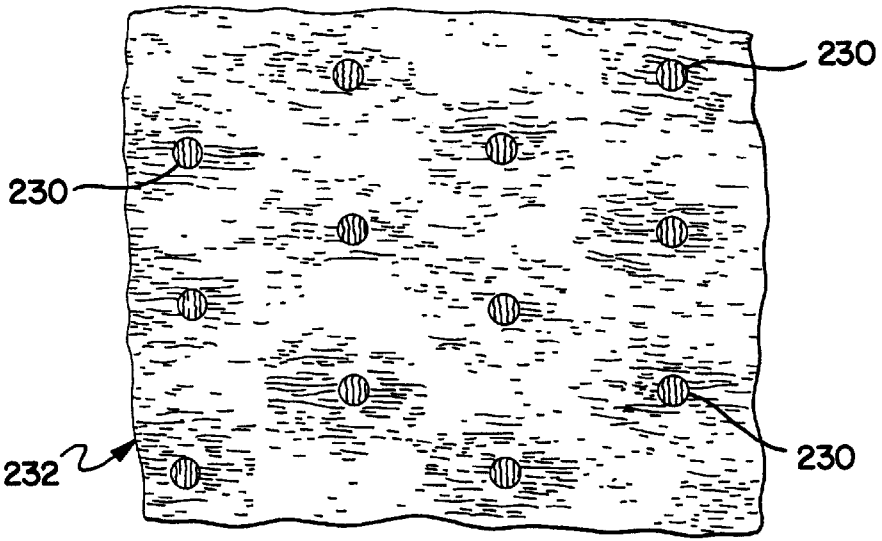
FIG. 4 illustrates a unconnected dot pattern of the bonding material applied on the web structure.

As shown in FIGS. 4 and 5, the bonding material 230 (such as vinyl acetate or acrylate homopolymer or copolymer cross-linking latex rubber emulsions) is applied to the web structure in the following predetermined manner. Preferred embodiments in accordance with the current invention include the bonding material 230 applied either in an unconnected discrete area pattern as shown in FIG. 4, or a connected mesh pattern as shown in FIG. 5. This process is also referred to as printing. The discrete areas may be unconnected dots or parallel lines. If the bonding material 230 is applied to the discrete unconnected areas, these areas should be spaced apart by distances less than the average fiber length according to the current invention. On the other hand, the mesh pattern application need not be spaced apart in the above limitation. Another limitation is related to penetration of the bonding material 230 into the web structure 119. Preferably, the bonding material 230 does not penetrate all the way across the thickness of the web structure 232 even if the bonding material 230 is applied to both top and bottom surfaces. The degree of penetration should be more than 10% but less than 60% of the thickness of the web structure 232. Preferably, the total weight of the applied bonding material 230 ranges from about 3% to about 20% of the total dry web weight. The degree of penetration of the bonding material 230 is affected at least by the basis weight of the web structure 232, the pressure applied to the web during application of the bonding material and the amount of time between application of the bonding material is well known to one of ordinary skill in the art.

The bonding material for the current invention generally has at least two critical functions. First, the bonding material interconnects the fibers in the web structure. The interconnected fibers provide additional strength to the web structure. However, the bonding material hardens the web and increases the undesirable coarse tactile sensation. For this reason, the above-described limited application minimizes the trade-off and optimizes the overall quality of the paper product. In addition to interconnecting the fibers, the bonding material, located on the surface, adheres to a creping drum and the web undergoes creping, as will be more fully described below. To satisfy these functions, preferably, the butadiene acrylonitrile type, other natural or synthetic rubber lattices, or dispersions thereof with elastomeric properties such as butadiene-styrene, neoprene, polyvinyl chloride, vinyl copolymers, nylon or vinyl ethylene terpolymer may be used according to the current invention.

Referring to FIG. 3, the web 119 with the one side coated with the bonding material optionally undergoes a drying station 129 for drying the bonding material 130. The dryer 129 consists of a heat source well known to the papermaking art. The web 119 is dried before it reaches the second bonding material application station 132, so that the bonding material already on the web is prevented from sticking to a press roller 134. Upon reaching the second bonding material application station 132, a rotogravure roller 135 applies the bonding material to the other side of the web 119. The bonding material 137 is applied to the web 119 in substantially the same manner as the first application of the bonding material 130. A pattern of the second application may or may not be the same as the first application. Furthermore, even if the same pattern is used for the second application, the patterns do not have to be in register between the two sides.

The web 119 now undergoes creping. The web structure 119 is transported to a creping drum surface 139 by a press roll 138. The bonding material 137 within holding pan 136, applied by the second bonding material application station 132 adheres to the creping drum surface 139, so that the web structure 119 removably stays on the creping drum 139 as the drum 139 rotates towards a doctor blade 140. One embodiment of the creping drum 139 is a pressure vessel such as a Yankee Dryer heated at approximately between 180° F. and 200° F. As the web structure 119 reaches the doctor blade 140, a pair of pull-rolls 141 pulls the web structure away from the doctor blade 140. As the web structure is pulled against the doctor blade 140, the web structure is creped as known to one of ordinary skill in the art. Optionally, the creped web structure may be further dried or cured by a curing or drying station 142 before rolled on a parent roll 143.

Creping improves certain properties of the web structure. Due to the inertia in the moving web structure 119 on the rotating creping drum 139 and the force exerted by the pull-rolls 141, the stationary doctor blade 140, causes portions of the web 119, which adhere to the creping drum surface 139 to have a series of fine fold lines. At the same time, the creping action causes the unbonded or lightly bonded fibers in the web to puff up and spread apart. Although the extent to which the web has the above-described creping effects depends upon some factors such as the bonding material, the dryer temperature, the creping speed and so on, the above-described creping generally imparts excellent softness, reduced fiber-to-fiber hydrogen bonding, and bulk characteristics in the web structure.

The above-described creping operation may be repeated so that both sides of the web structure is creped. Such a web structure is sometimes referred to as double creped web structure. Furthermore, at least one side of the web may be creped twice in the double recreped web structure. For example, a web structure having a side A and a side B may be treated in the following steps: a) through-drying, b) printing on the side A, c) creping again on the side A, d) printing on the side B, and e) creping on the side B.

Figure 6:
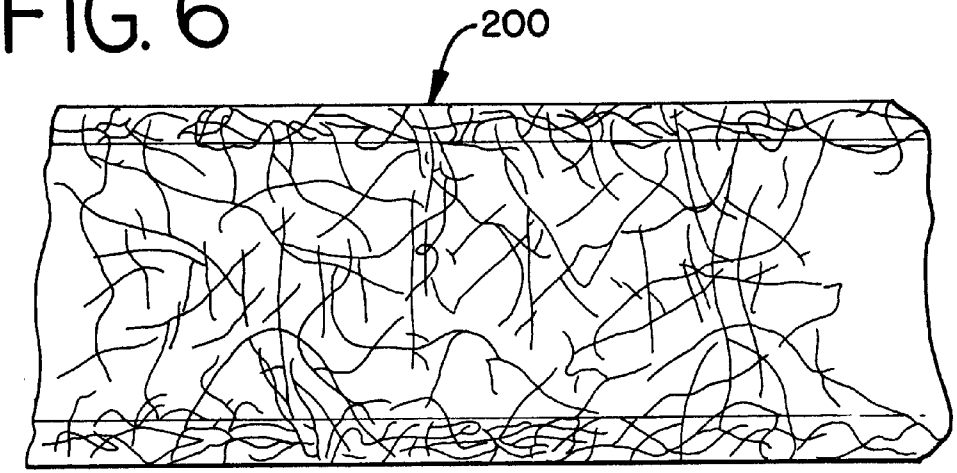
FIG. 6 illustrates a cross-sectional view of one preferred embodiment having a substantially non-laminar web structure prepared from a stratified web preparation.
Figure 7:
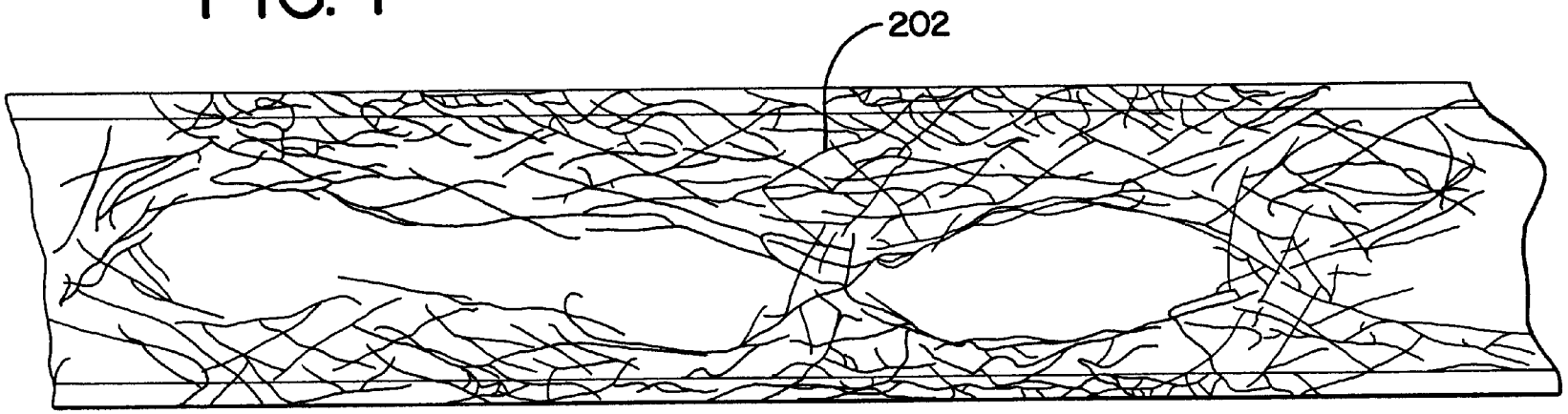
FIG. 7 illustrates a cross-sectional view of a wet-pressed double recreped web structure.

According to a preferred embodiment of the current invention, an additional high-temperature hood 144, is provided adjacent to the creping drum 139, and the doctor blade 140. The temperature of the hood 144, is approximately 500° F. and primarily heats the top surface of the web 119, as it approaches the doctor blade 140. The top surface of the web 119, thus, has a substantially higher temperature than a bottom surface that directly lays on the creping drum 139. Such a temperature difference between the top surface and the bottom surface of the web 119 enhances the above-described creping effect in such a way that causes the fibers to orient themselves in a vertical or Z direction across the thickness of the web structure. To achieve this fiber orientation, the high temperature hood 144 is helpful, but not necessary to practice the current invention. Referring to FIG. 6, a cross-sectional view of a through-dried post bonded, and creped web structure 200 is shown. For comparison, FIG. 7, shows a standard wet-pressed double recreped structure 202, which has less bulk, strength and softness than the through-dried web structure 200, of FIG. 6.

High TWA is also a result of the bonding material applied in the above-described pattern. Generally, water absorption rate is hindered by the water resistant bonding material coated on the web surface. To increase the water absorption rate, the bonding material according to the current invention is applied to less than 60% of the surface area, leaving a significant intact surface area where water freely passes into the web structure. Furthermore, as shown in FIGS. 4 and 5, in preferred embodiments, the above-limited bonding material is applied in an unconnected dot pattern or a connected mesh pattern.

The above-described high TWA characteristic of the non-collapsible web structure of the current invention does not sacrifice a softness characteristic. Generally, as described above, softness is sacrificed as a trade-off when the web structure is strengthened for higher TWA. However, according to the current invention, the bonding material is applied to a limited area of surface area, and a large portion of the web surface is not affected by the bonding material. The bonding material is also preferably applied to penetrate only a portion of the thickness.

Referring to the chart of FIG. 8, data collected on the following web structures: A1–5 are web structures comprising 40% non-premium fiber and resulting from the process of the invention, which includes a uncreped through-air-dried (UCTAD) process followed by bonding and double recreped B1 is also a UCTAD web which is bonded and double recreped, but comprises 100% premium fiber; C1–2 use a wet-press process with double recrepe and comprise 40% non-premium (C1) and 100% premium fiber (C2), respectively. Curled fiber includes, for example, fibers produced by the Weyerhaeuser HBA process. Curled RF refers to curled recycled fibers processed by Kimberly-Clark Corporation. The physical tests includes the following, which those of skill in the art are familiar:

1) Machine Direction Strength (MD); 2) Machine Direction Stretch (MDS); 3) Cross-Directional Strength (CD); 4) Cross-Directional Strength (CDS); 5) Cured Cross-Directional Wet Tensile (CCDWT); 6) Bulk; 7) Basis Weight (BW); 8) Bulk/Basis Weight (BLK/BW); 9) Tabor Abrasion (ABR); 10) Total Water Absorbency (TWA); 11) Oil Capacity (Oil Cap) and 12) Z-Peel. As shown in FIG. 8, the CCDWT and Bulk or BLK/BW of the web structure of A1–A5 is at least about 85% of the CCDWT of the web structure of C2, which uses 100% premium fiber and a wet-press process. FIG. 8, also shows that the recycled fibers used in A1–A5 actually has increased total water absorbency (TWA) over both the web structure of B1, and C1–2.

Referring to the chart of FIG. 9, tests were also run using the through-air-dried, bonded, and double recrepe process for lower basis weight product, except for Example 1, which used a wet-press with double recrepe 100% NSWK. Example 2 used 40% bleached old corrugated container (OCC) fiber and was through-air-dried, printed or bonded, and then creped. Example 3 used 100% NSWK with no debonder and was through-air-dried, bonded, and double recreped. Example 4 used 100% NSWK with 0.2% debonder and was through-air-dried, but not double recreped. Example 5 used 85% NSWK with 15% ¼ inch polyester in middle and was through-air-dried, bonded, and double recreped. As can be seen by comparing the control of Example 1 with Example 2, similar strength and BLK/BW were achieved using 40% recycled fibers and a through-air-dried, bonded, and double recrepe process. A normal wet-press with 40% recycled fibers may have a bulk of, for example, 12.5. Examples 3–5 show the higher CCDWT, along with higher BLK/BW when using the through-air-dried, bonded, and double recrepe process.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

We claim:

1. A method for forming a fibrous web comprising:

providing a fibrous web comprising at least about 20% secondary fiber, said fibrous web having a first and second side;

through air drying the fibrous web;

applying bonding material to a portion of said first side of the fibrous web and penetrating said fibrous web from said first side with said bonding material to a depth of from about 10 percent to about 60 percent of a thickness of said fibrous web;

drying the fibrous web with the bonding material;

creping the fibrous web a single time on said first side of said fibrous web;

applying bonding material to a portion of said second side of said fibrous web and penetrating said fibrous web from said second side with said bonding material to a depth of from about 10 percent to about 60 percent of said thickness of said fibrous web;

drying said fibrous web after said bonding material is applied to said second side; and creping said second side of said fibrous web.

2. The method of claim 1 further comprising providing a negative draw prior to through air-drying said fibrous web.

3. The method of claim 1 wherein the fibrous web comprises at least about 20% recycled fibers.

4. The method of claim 1 wherein said second side is creped only a single time.

5. The method of claim 1 wherein the fibrous web comprises a combination of recycled fibers and hardwood fibers.

6. The method of claim 1 wherein said applying said bonding material to a portion of said first side of said fibrous web comprises applying said bonding material in a pattern occupying from about 15 percent to about 60 percent of the surface area of the web.

7. The method of claim 1 wherein said applying said bonding material to a portion of said second side of said fibrous web comprises applying said bonding material in a pattern occupying from about 15 percent to about 60 percent of the surface area of the web.

8. The method of claim 1 wherein said applying said bonding material to a portion of said first side of said fibrous web comprises applying said bonding material in an unconnected discrete area pattern.

9. The method of claim 1 wherein said applying said bonding material to a portion of said first side of said fibrous web comprises applying said bonding material in a connected mesh pattern.

10. The method of claim 1 wherein said fibrous web comprises softwood fibers.

11. The method of claim 1 wherein said fibrous web comprises a combination of recycled and softwood fibers.

12. The method of claim 1 wherein said fibrous web comprises recycled and polyester fibers, wherein said polyester fibers have a length of between about 3 mm and 7 mm.

13. The method of claim 1 wherein said fibrous web comprises a combination of recycled and hardwood fibers.

14. The method of claim 1 wherein said fibrous web does not include any chemical debonder.

15. The method of claim 1 wherein said fibrous web comprises curled recycled fibers.

16. The method of claim 1 wherein said fibrous web comprises curled softwood fibers.

17. The method of claim 1 wherein said fibrous web comprises CTMP fibers.

18. The method of claim 1 wherein said bonding material applied to said portion of said first side and which penetrates said fibrous web from said first side does not substantially interconnect with said bonding material applied to said portion of said second side and which penetrates said fibrous web from said second side.

19. A web structure comprising:

a through-air-dried, bonded, creped fibrous web having a first and second side and comprising at least about 20% of secondary fiber and a bonding material applied across portions of said first and second sides of the web, wherein said bonding material extends from about 10 percent to about 60 percent through a thickness of said fibrous web from each of said first and second sides, wherein said web is creped on said first and second sides.

20. The web structure of claim 19 wherein the fibrous web comprises at least about 20% recycled fibers.

21. The web structure of claim 19 wherein the bonding material is applied in a pattern occupying from about 15 percent to about 60 percent of the surface area of the web.

22. The web structure of claim 19 wherein said web has a TWA greater than about 511 g/m2.

23. The web structure of claim 19 wherein said web has a BLK/BW of at least about 12 mils/#.

24. The web structure of claim 23 wherein said web has a CCDWT of at least about 22 oz/in respectively.

25. The web structure of claim 19 wherein said bonding material is applied across portions of said first side of said fibrous web in an unconnected discrete area pattern.

26. The web structure of claim 19 wherein said bonding material is applied across portions of said first side of said fibrous web in a connected mesh pattern.

27. The web structure of claim 19 wherein said fibrous web comprises softwood fibers.

28. The web structure of claim 19 wherein said fibrous web comprises a combination of recycled and softwood fibers.

29. The web structure of claim 19 wherein said fibrous web comprises recycled and polyester fibers, wherein said polyester fibers have a length of between about 3 mm and 7 mm.

30. The web structure of claim 19 wherein said fibrous web comprises a combination of recycled and hardwood fibers.

31. The web structure of claim 19 wherein said fibrous web does not include any chemical debonder.

32. The web structure of claim 19 wherein said fibrous web comprises curled recycled fibers.

33. The web structure of claim 19 wherein said fibrous web comprises curled softwood fibers.

34. The web structure of claim 19 wherein said fibrous web comprises CTMP fibers.

35. The web structure of claim 19 wherein said bonding material applied to said portion of said first side and which penetrates said fibrous web from said first side does not substantially interconnect with said bonding material applied to said portion of said second side and which penetrates said fibrous web from said second side.

36. A method for forming a fibrous web comprising:

providing a fibrous web comprising at least about 20% secondary fiber, said fibrous web having a first and second side;

through air drying the fibrous web;

applying bonding material to a portion of said first side of the fibrous web and penetrating said fibrous web from said first side with said bonding material to a depth of from about 10 percent to about 60 percent of a thickness of said fibrous web;

drying the fibrous web with the bonding material; and creping the fibrous web a single time on said first side of said web, wherein said web has a BLK/BW and a CCDWT of at least about 12 mils/# and 22 oz/in respectively.

37. The method of claim 36 further comprising providing a negative draw prior to through air-drying said fibrous web.

38. The method of claim 36 wherein the fibrous web comprises at least about 20% recycled fibers.

39. The method of claim 36 further comprising applying bonding material to a portion of said second side of said fibrous web.

40. The method of claim 39 further comprising drying said fibrous web after said bonding material is applied to said second side and then creping said second side of said fibrous web.

41. The method of claim 40 wherein said second side is creped only a single time.

42. The method of claim 36 wherein the fibrous web comprises a combination of recycled fibers and hardwood fibers.

43. The method of claim 36 wherein said applying said bonding material comprises applying said bonding material in a pattern occupying from about 15 percent to about 60 percent of the surface area of said first side of said fibrous web.

44. The method of claim 36 wherein said applying said bonding material to a portion of said first side of said fibrous web comprises applying said bonding material in an unconnected discrete area pattern.

45. The method of claim 36 wherein said applying said bonding material to a portion of said first side of said fibrous web comprises applying said bonding material in a connected mesh pattern.

46. The method of claim 36 wherein said fibrous web comprises softwood fibers.

47. The method of claim 36 wherein said fibrous web comprises a combination of recycled and softwood fibers.

48. The method of claim 36 wherein said fibrous web comprises recycled and polyester fibers, wherein said polyester fibers have a length of between about 3 mm and 7 mm.

49. The method of claim 36 wherein said fibrous web comprises a combination of recycled and hardwood fibers.

50. The method of claim 36 wherein said fibrous web does not include any chemical debonder.

51. The method of claim 36 wherein said fibrous web comprises curled recycled fibers.

52. The method of claim 36 wherein said fibrous web comprises curled softwood fibers.

53. The method of claim 36 wherein said fibrous web comprises CTMP fibers.

54. A method for forming a fibrous web comprising:

providing a fibrous web comprising at least about 20% secondary fiber, said fibrous web having a first and second side;

through air drying the fibrous web;

applying bonding material to a portion of said first side of the fibrous web and penetrating said fibrous web from said first side with said bonding material to a depth of from about 10 percent to about 60 percent of a thickness of said fibrous web;

drying the fibrous web with the bonding material; and creping the fibrous web a single time on said first side of said web, wherein said web structure has a TWA greater than about 511 g/m2.

55. The method of claim 54 further comprising providing a negative draw prior to through air-drying said fibrous web.

56. The method of claim 54 wherein the fibrous web comprises at least about 20% recycled fibers.

57. The method of claim 54 further comprising applying bonding material to a portion of said second side of said fibrous web.

58. The method of claim 57 further comprising drying said fibrous web after said bonding material is applied to said second side and then creping said second side of said fibrous web.

59. The method of claim 58 wherein said second side is creped only a single time.

60. The method of claim 54 wherein the fibrous web comprises a combination of recycled fibers and hardwood fibers.

61. The method of claim 54 wherein said applying said bonding material comprises applying said bonding material in a pattern occupying from about 15 percent to about 60 percent of the surface area of said first side of said fibrous web.

62. The method of claim 54 wherein said applying said bonding material to a portion of said first side of said fibrous web comprises applying said bonding material in an unconnected discrete area pattern.

63. The method of claim 54 wherein said applying said bonding material to a portion of said first side of said fibrous web comprises applying said bonding material in a connected mesh pattern.

64. The method of claim 54 wherein said fibrous web comprises softwood fibers.

65. The method of claim 54 wherein said fibrous web comprises a combination of recycled and softwood fibers.

66. The method of claim 54 wherein said fibrous web comprises recycled and polyester fibers, wherein said polyester fibers have a length of between about 3 mm and 7 mm.

67. The method of claim 54 wherein said fibrous web comprises a combination of recycled and hardwood fibers.

68. The method of claim 54 wherein said fibrous web does not include any chemical debonder.

69. The method of claim 54 wherein said fibrous web comprises curled recycled fibers.

70. The method of claim 54 wherein said fibrous web comprises curled softwood fibers.

71. The method of claim 54 wherein said fibrous web comprises CTMP fibers.

72. A method for forming a fibrous web comprising:

providing a fibrous web comprising at least about 20% secondary fiber, said fibrous web having a first and second side;

through air drying the fibrous web;

applying bonding material to a portion of said first side of the fibrous web and penetrating said fibrous web from said first side with said bonding material to a depth of from about 10 percent to about 60 percent of a thickness of said fibrous web;

drying the fibrous web with the bonding material;

creping the fibrous web on said first side of said fibrous web;

applying bonding material to a portion of said second side of said fibrous web and penetrating said fibrous web from said second side with said bonding material to a depth of from about 10 percent to about 60 percent of said thickness of said fibrous web;

drying said fibrous web after said bonding material is applied to said second side; and creping the fibrous web on said second side of said fibrous web.

73. The method of claim 72 wherein said fibrous web is creped a single time on said first side.

74. The method of claim 72 wherein said fibrous web is creped a single time on said second side.

75. The method of claim 72 further comprising providing a negative draw prior to through air drying said fibrous web.

76. The method of claim 72 wherein the fibrous web comprises at least about 20% recycled fibers.

77. The method of claim 72 wherein the fibrous web comprises a combination of recycled fibers and hardwood fibers.

78. The method of claim 72 wherein applying said bonding material to said first and second sides of said fibrous web comprises applying said bonding material to at least one of said first and second sides in a pattern occupying from about 15 percent to about 60 percent of the surface area of said at least said one of said first and second sides of said fibrous web.

79. The method of claim 72 wherein said applying said bonding material to a portion of said first side of said fibrous web comprises applying said bonding material in an unconnected discrete area pattern.

80. The method of claim 72 wherein said applying said bonding material to a portion of said first side of said fibrous web comprises applying said bonding material in a connected mesh pattern.

81. The method of claim 72 wherein said fibrous web comprises softwood fibers.

82. The method of claim 72 wherein said fibrous web comprises a combination of recycled and softwood fibers.

83. The method of claim 72 wherein said fibrous web comprises recycled and polyester fibers, wherein said polyester fibers have a length of between about 3 mm and 7 mm.

84. The method of claim 72 wherein said fibrous web comprises a combination of recycled and hardwood fibers.

85. The method of claim 72 wherein said fibrous web does not include any chemical debonder.

86. The method of claim 72 wherein said fibrous web comprises curled recycled fibers.

87. The method of claim 72 wherein said fibrous web comprises curled softwood fibers.

88. The method of claim 72 wherein said fibrous web comprises CTMP fibers.

89. The method of claim 72 wherein said web structure has a TWA greater than about 511 g/m2.

90. The method of claim 72 wherein said web has a BLK/BW of at least about 12 mils/#.

91. The method of claim 90 wherein said web has a CCDWT of at least about 22 oz/in.

92. The method of claim 72 wherein said bonding material applied to said portion of said first side and which penetrates said fibrous web from said first side does not substantially interconnect with said bonding material applied to said portion of said second side and which penetrates said fibrous web from said second side.

* * * * *